US011406984B2

(12) United States Patent
Kusogullari et al.

(10) Patent No.: US 11,406,984 B2
(45) Date of Patent: Aug. 9, 2022

(54) TRANSPORT STRUCTURE FOR A PLURALITY OF VIALS FOR PHARMACEUTICAL, MEDICAL OR COSMETIC USE, STERILE PACKAGING STRUCTURE AND PROCESS FOR PROCESSING VIALS

(71) Applicant: SCHOTT Schweiz AG, St. Gallen (CH)

(72) Inventors: Levent Kusogullari, Winterthur (CH); Marco Apolloni, Marbach (CH); Gregor Fritz Deutschle, Idstein (DE)

(73) Assignee: SCHOTT SCHWEIZ AG, St. Gallen (CH)

( * ) Notice: Subject to any disclaimer, the term of this patent is extended or adjusted under 35 U.S.C. 154(b) by 355 days.

(21) Appl. No.: 16/166,366

(22) Filed: Oct. 22, 2018

(65) Prior Publication Data

US 2019/0054472 A1 Feb. 21, 2019

Related U.S. Application Data

(63) Continuation of application No. PCT/EP2017/053871, filed on Feb. 21, 2017.

(30) Foreign Application Priority Data

Apr. 22, 2016 (DE) ..... 102016107536.1

(51) Int. Cl.
*B01L 9/06* (2006.01)
*B01L 3/00* (2006.01)

(52) U.S. Cl.
CPC ..... *B01L 9/06* (2013.01); *B01L 3/5025* (2013.01); *B01L 2200/087* (2013.01);
(Continued)

(58) Field of Classification Search
CPC ..... B01L 2300/0809; B01L 2300/0835; B01L 2300/0609; B01L 9/06; B01L 2200/18; B01L 2200/087; B01L 3/5025
See application file for complete search history.

(56) References Cited

U.S. PATENT DOCUMENTS 4,730,730 A 3/1988 Clarkson
8,360,238 B2 1/2013 Nicoletti
(Continued)

FOREIGN PATENT DOCUMENTS

EP 2659922 11/2013
EP 2896406 7/2015
WO 2013181552 12/2013

OTHER PUBLICATIONS

English translation of International Search Report dated May 29, 2017 for corresponding PCT/EP2017/053871, 2 pages.
(Continued)

*Primary Examiner* — Rebecca M Fritchman
(74) *Attorney, Agent, or Firm* — Ohlandt, Greeley, Ruggiero & Perle, L.L.P.

(57) ABSTRACT

A transport structure for accommodating a plurality of vials for pharmaceutical, medical or cosmetic use under non-sterile conditions is formed by an accommodation member and by a bearing member releasably connected thereto. The accommodation member comprises a plurality of frustro-conical receptacles in a regular arrangement so that the vials can be accommodated upright and while preventing a direct contact between adjacent vials in the receptacles of the accommodation member. The transport structure comprises latching structures for releasable latching of the accommodation member with the bearing member. According to the disclosure, the receptacles are matched to the height of the vials in such a manner that the vials can be completely accommodated therein, wherein the bearing member is
(Continued)

formed by a base plate having a flat supporting surface facing the receptacles, so that the vials can be freely displaced on the supporting surface of the base plate after releasing the latching and can be pushed from the bearing member by displacement of the accommodation member relative to the bearing member. The accommodation member and/or the bearing member can be formed in one piece by thermoforming a plastic material, in particular by deep-drawing a thin film or a thin film plate.

22 Claims, 11 Drawing Sheets

(52) U.S. Cl.
CPC ... *B01L 2200/18* (2013.01); *B01L 2300/0609* (2013.01); *B01L 2300/0809* (2013.01); *B01L 2300/0835* (2013.01)

(56) References Cited

U.S. PATENT DOCUMENTS

| | | | | |
|---|---|---|---|---|
| 2005/0186121 | A1* | 8/2005 | West | B01L 3/50853 422/400 |
| 2011/0226662 | A1* | 9/2011 | Nicoletti | B65D 5/503 206/562 |
| 2014/0027342 | A1 | 1/2014 | Pawlowski | |
| 2015/0114871 | A1* | 4/2015 | Fitzpatrick | B01L 9/06 206/508 |
| 2015/0183541 | A1 | 7/2015 | Deutschle | |

OTHER PUBLICATIONS

Written Opinion of the International Searching Authority with English translation dated May 29, 2017 for corresponding PCT/EP2017/053871, 7 pages.

* cited by examiner

A-A

10

A-A

B-B

TRANSPORT STRUCTURE FOR A PLURALITY OF VIALS FOR PHARMACEUTICAL, MEDICAL OR COSMETIC USE, STERILE PACKAGING STRUCTURE AND PROCESS FOR PROCESSING VIALS

CROSS-REFERENCE TO RELATED APPLICATION

The present application is a continuation of International Patent Application No. PCT/EP2017/053871, filed on Feb. 21, 2017, which in turn claims priority to German patent application No. 10 2016 107 536.1, 'Transport structure for a plurality of vials for pharmaceutical, medical or cosmetic use, sterile packaging structure and process for processing vials', filed on Apr. 22, 2016, the content of each of which is hereby expressly incorporated by way of reference.

FIELD OF THE DISCLOSURE

The present disclosure generally relates to the processing of a plurality of vials for storage of substances for pharmaceutical, medical or cosmetic use and particularly relates to a transport structure without a sterility barrier for the temporary storage and transport of such vials under non-sterile conditions, which enables a simple feeding of vials to a processing station. Further aspects of the present disclosure relate to a sterile packaging structure comprising at least one such transport structure and to a process for processing vials.

BACKGROUND OF THE DISCLOSURE

Vials are used on a large scale as containers for storage and storing medical, pharmaceutical or cosmetic products with administration in liquid form, particularly in pre-dosed quantities. These generally have a cylindrical shape, can be made of plastic or glass and are available in large quantities at low cost.

Box-shaped transport and packaging containers are often used for storage and transport of the vials, as discloses in U.S. Pat. No. 8,360,238 B2, for example, which are sterile sealed against the environment by means of a sterile protective foil and may additionally be accommodated sterile in a sterile outer packaging bag. In the box-shaped transport and packaging container a holding structure for the vials is accommodated, which holds a plurality of vials and can be removed together with the vials from the transport and packaging container for further processing. However, the removal of the holding structure from the box-shaped transport and packaging container requires special gripping arms, which increases the efforts required.

For further transport and packaging concepts, the vials first always need to be turned over for feeding to a processing station, which is time-consuming.

In an effort to provide a simplified transport and packaging container, EP 2 659 922 A2 discloses that the vials and their bottoms are placed upright on a flat carrier, which may also be designed as a gas-permeable protective film. A box-shaped transport and packaging container is placed upside down on the flat carrier and connected to the flat carrier so that the vials can be fed to a processing station without turning. Usually, however, a circumferential side-wall on the flat carrier prevents the vials from simply being pushed from the flat carrier after lifting off the box-shaped transport and packaging container. However, in the case of embodiments where such a circumferential side-wall is not provided on the flat support, an adhesive bonding between the box-shaped transport and packaging container and the flat carrier is required, which increases the effort. In particular, the vials cannot be pushed down from the flat carrier after releasing the adhesive bonding. Rather, they must be lifted off.

WO 2013181552 A2 discloses a transport structure according to the preamble of claim 1, comprising an upper part and a lower part detachably connected to it. The upper part comprises a plurality of receptacles in a regular arrangement, the height of which is smaller than the length of the vials so that the vials can be accommodated in the receptacles of the upper part while preventing a direct contact with adjacent vials but protrude from the upper ends of the receptacles of the upper part. The upper part and the lower part are detachably latched together by means of latching structures.

A plurality of trough-shaped depressions is formed on the upper side of the lower part, on which the bottoms of the vials rest directly when the upper part and lower part are connected to each other. A sterile protective foil is bonded to the back of the lower part. For feeding the vials to a processing station, first the protective foil is removed from the back of the lower part in an upside-down position, i.e. with the upper part facing downwards. Afterwards, the remaining transport structure consisting of the upper part and the associated lower part must first be turned before the vials can be pushed onto a base of the processing station by relative displacement of the upper part and lower part. This turning process is not always easy to implement in practice. The relative displacement of the upper part and lower part results in a height offset of the upper part due to the shape of the latching structures, which can be disadvantageous.

The depressions of the lower part must extend at least at one end up to the edge of the lower part so that the vials can be pushed out of the depressions at all. This reduces the stability of the lower part, particularly if it shall be made of thin plastics to save as much material as possible.

SUMMARY OF THE DISCLOSURE

It is an object of the present disclosure to provide a cost-effective and easy-to-handle transport structure with which vials can be fed to processing stations in a simpler and more cost-effective manner. Furthermore, a sterile packaging structure and a process for processing vials is to be provided in which the vials can be easily and cost-effectively fed to a processing station.

According to the present disclosure, the bearing member is formed by a flat base plate having a flat supporting surface that faces the receptacles so that the vials can be freely displaced on the supporting surface of the base plate after releasing the latching and can be pushed from the bearing member by moving the accommodation member relative to the bearing member. Here, the receptacles are matched to the heights of the vials in such a manner that the vials are completely accommodated therein, i.e. they do not protrude out of the receptacles.

Because the base plate of the bearing member is flat, the vials can be pushed from the base plate without a height offset and thus unhindered. Generally, the displacement of the vials may be performed in any direction because they are not guided laterally in receptacles on the upper side of the base plate of the bearing member. According to the present disclosure, the base plate of the bearing member can also be designed to be torsion-resistant in a simple manner, for which purpose the supporting surface formed by the base plate may be divided into a plurality of rectangular supporting surfaces by relatively narrow grooves. This enables in particular the use of thin wall thicknesses, which helps to reduce the use of materials and in particular enables the production of the bearing member by means of a simple and cost-effective thermoforming, in particular by deep-drawing from thin plastic films or plastic film plates. Particularly in the case of manufacturing using deep-drawing, the edges of these grooves or supporting surfaces are automatically rounded so that the vials can be pushed reliably and free of vibrations over the plane spanned by these supporting surfaces.

Such a transport structure is intended in particular for the transport and storage of vials under non-sterile conditions, which, for the purposes of the present application, shall mean in particular that the vials are not airtightly packaged in the transport structure without additional sealing measures, such as packaging of the transport structure in a sterile outer packaging bag made of a plastic material, in a sterile tube of plastic material or the like or in an additional sterile packaging container or the like, so that germs and particles could theoretically flow into the interior of the transport structure laterally via gaps which are not airtightly sealed. Nevertheless, the penetration of germs, particles or the like from above and directly into the filling openings of the vials is reliably prevented, because the filling openings are completely covered by the accommodation member.

According to a further embodiment, a transport at particularly low vibrations can be accomplished because the receptacles are matched to the heights of the vials in such a manner that the bottoms of the vials accommodated in the receptacles are in direct contact with the supporting surface of the bearing member, i.e. the vials are accommodated so as to be secured in axial direction.

According to a further embodiment, the accommodation member is releasably connected to the bearing member without additional frictional coupling, in particular without additional clamping on the bearing member or without additional clamping by the bearing member. This enables an advantageously simple handling.

According to a further embodiment, the latching structures are accessible from the side of the accommodation member. This can provide advantages when handling the transport structure, especially under confined or sterile conditions.

According to a further embodiment, the vials can be pushed from the bearing member without lifting or any height offset of the accommodation member after releasing the latching of the accommodation member with the bearing member. This may provide advantages when feeding the vials to a processing station, especially under confined or sterile conditions.

According to a further embodiment, the latching of the latching structures can be formed and released again by adjusting moveable members on the bearing member or on the accommodation member without lifting or height offset of the accommodation member. This can provide additional advantages when feeding the vials to a processing station, especially under confined or sterile conditions. Particularly for the automated handling of the transport structure, it may be advantageous if the latching structures are accessible from the side of the accommodation member to release their latching, because the bearing member can then rest on a supporting surface, for example on a machine frame of a processing station.

Furthermore, a particularly simple and convenient adjustment can be accomplished by these measures, because the side wings can be folded down for forming the transport structure and, if necessary, also for enabling the latching by simply approaching a slider or the like to the bearing member from the side.

Latching is particularly simple and convenient if the latching structures of the bearing member can simply be pressed onto the latching structures of the accommodation member for enabling the latching. For this purpose, the latching structures may be mushroom-shaped in profile, similar to pushbuttons, with a constricted portion and an adjoining expanded portion, which cooperate with each other in a form-fitting manner in order to effect latching by form-fitting.

Since temporary expansion or stretching of the side wings may be required when folding over the side wings and latching the latching structures, according to a further embodiment compensating or stiffening portions may be provided, which may serve to compensate for such temporary expansions or stretching but also for further stiffening of the side wings. These may extend particularly along the edge of the bearing member. Additional compensating or stiffening portions may be formed on the side wings, in particular to temporarily compensate for an expansion of the material of the side wings when the latching structures are latched.

According to a further embodiment, the compensating or stiffening portions may be formed in particular as recessed portions, which enables advantages in production, in particular in the manufacturing by thermoforming the material of the bearing member, in particular by deep-drawing this material, this material being in particular a plate-shaped plastic material.

It is particularly convenient that according to a further embodiment the vials can be pushed down from the base plate of the bearing member if the bearing member comprises only two foldable side wings on two opposite sides of the bearing member, because then no side wing can hinder the pushing down of the vials.

According to a further embodiment, the displacement of the accommodation member relative to the bearing member is guided laterally so that the vials can only be pushed from the bearing member in a controlled manner along a single direction, which allows the vials to be fed to a processing station under still better controlled conditions.

An additional reinforcement of the bearing member can be accomplished by forming relatively narrow grooves between several supporting surfaces formed on the base plate of the bearing member, which offers particular advantages in the production of the bearing member by thermoforming, in particular by deep-drawing, from a thin plastic foil or plastic foil plate. For this purpose, the grooves are preferably formed as relatively narrow grooves, for example with a width of less than 3 mm, preferably with a width of about 1 mm. In any case, it is preferred if the width of the grooves between the supporting surfaces is significantly smaller than the outer diameter of the vials in the region of their closed lower ends (bottoms), since the vials can then be pushed smoothly over the plurality of supporting surfaces of the base plate of the bearing member.

For this purpose, the supporting surface of the base plate facing the receptacles may be formed by a plurality of supporting surfaces which together span a plane and which are arranged relative to the associated receptacles such that the bottoms of the vials can respectively rest directly on these supporting surfaces, the aforementioned grooves being formed between the supporting surfaces, the width of which is very small as compared to the diameter of the vials.

According to a further embodiment, a plurality of depressions or troughs are formed on an underside of the base plate facing away from the accommodation member, which are separated from one another by partitioning webs, the width of the troughs preferably corresponding to an outer diameter of the receptacles in the region of the bottoms of the receptacles of the accommodation member. Thus, several transport structures can be arranged stacked one above the other in a stacked arrangement, in which the front ends of the receptacles of the accommodation member of a first transport structure are accommodated directly in the troughs of the bearing member of a second transport structure and secured against lateral slipping.

The base plate can be produced easily and cost-effectively if the partitioning webs between the troughs on the underside correspond to the grooves between the supporting surfaces on the upper side of the base plate of the bearing member and if the troughs on the underside of the base plate correspond to the supporting surfaces on the upper side of the base plate of the bearing member. Thus, in particular several bearing members can be stacked on top of each other to save space.

A plurality of accommodation members can be stored stacked on top of each other to save space, especially if the receptacles are of frustro-conical design.

The transport structure according to the present disclosure is preferably used for the transport of vials not yet sterile packed, for example to a pharmaceutical filling company, where filling takes place after cleaning and sterilization of the vials. For this purpose, no additional sterility barrier is provided on the transport structure. In particular, lateral gaps between the accommodation member and the bearing member are not sealed sterile and gas-tight by further measures, such as seals or the like, so that air or a gas may always flow laterally into the interior of the transport structure, which may cause the at least theoretical intrusion of particles and germs into the interior of the transport structure.

If a transport in the transport structure according to the present disclosure is nevertheless desired under sterile conditions, for example the transport of cleaned and sterilized vials to a pharmaceutical filling company in a 'ready to use' (RTU) state, the transport structure with the vials accommodated therein is cleaned and sterilized and placed in at least one sterile outer packaging bag, for example in a plastic bag or plastic tube, or in an additional transport container, which is then sterile sealed.

A further aspect of the present disclosure relates to a transport structure, as set forth herein, in the receptacles of which a plurality of vials is accommodated.

A further aspect of the present disclosure relates to a process for processing a plurality of vials for pharmaceutical, medical or cosmetic use in a processing station, comprising the steps of: feeding a transport structure as set forth herein together with the vials accommodated therein to the processing station, in which transport structure the accommodation member is connected to the bearing member by latching, the vials are completely accommodated in the receptacles of the accommodation member in an upright position while a direct contact of adjacent vials is prevented; releasing the latching of the latching structures, in particular from the side of the accommodation member of the transport structure and without height offset of the accommodation member relative to the bearing member; displacing the accommodation member relative to the bearing member and in particular without height offset of the accommodation member relative to the bearing member, for pushing the vials freely from the base plate of the bearing member and feeding them to the processing station; and processing the vials in the processing station. After releasing the latching of the latching structures, the accommodation member is displaced relative to the bearing member for pushing the vials from the flat base plate and for feeding them to the processing station. According to the present disclosure, this does not require turning the transport structure with the vials accommodated therein.

BRIEF DESCRIPTION OF THE DRAWINGS

In the following, the disclosure will be described in an exemplary manner and with reference to the appended drawings, from which further features, advantages and problems to be solved will become apparent. In the drawings.

In the drawings, identical reference numerals designate identical or essentially equivalent elements or groups of elements.

DETAILED DESCRIPTION OF THE DISCLOSURE

Figure 1A:
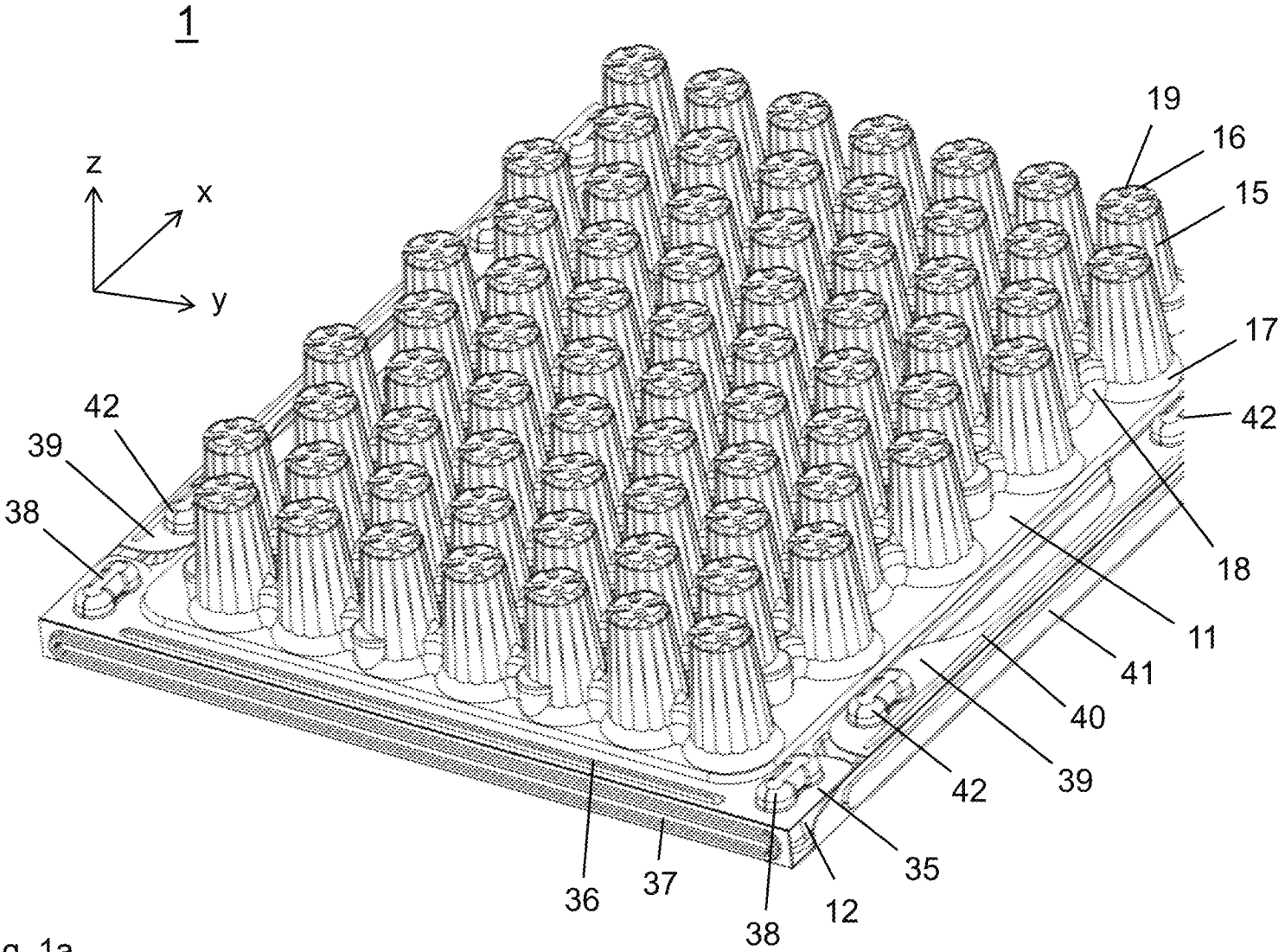
FIG. 1*a* shows a transport structure according to a first embodiment of the present disclosure in a perspective plan view.

As described hereinafter, according to the present disclosure a transport structure serves for the temporary, non-sterile storage and transport of a plurality of vials (hereinafter also referred to as containers) for the storage of substances for medical, pharmaceutical or cosmetic applications in a regular arrangement, for example in a matrix arrangement with regular distances between the containers along two different spatial directions, preferably along two mutually orthogonal spatial directions. For this purpose, the transport structure has no sterility barrier, in particular no circumferential sterile sealing between the bearing member and the accommodation member and no sterile protective foil or film for sterile sealing of the transport structure. Rather, the vials are stored or transported in the transport structure under non-sterile conditions. If sterile conditions are required for storage or transport of the containers, this is rather accomplished by means of at least one sterile outer packaging bag, which accommodates at least one transport structure, for example by means of a plastic tube, in which a gas-permeable, sterile protective film may be provided in portions, which may, for example, be formed by a braid of plastic fibers, such as polypropylene fibers (PP), or a Tyvek® protective film, to allow sterilization of the inner volume of the outer packaging bag and the outside of the transport structure by a flow of a sterilizing gas flowing into the outer packaging bag.

According to FIG. 1*a*, the transport structure 1 comprises an accommodation member having a plurality of frustro-conical receptacles in which the vials are accommodated and a substantially plate-shaped bearing member, which are detachably connected to each other by means of latching structures 38, 42 which will be described in more detail below.

According to FIGS. 2*a* to 3*c*, the accommodation member 10 is formed by a flat base plate 11 from which a plurality of frustro-conical receptacles 14 protrude, which are formed by circumferential side-walls 15 and which are closed at their upper ends by closed bottoms 16, on the underside of which each four protrusions 19 are provided, so that the upper ends of the vials to be accommodated are accommodated at a distance from the bottoms 16 of the receptacles 14. The inner diameter of the receptacles 14 decreases from their open ends to the bottoms 16; preferably the inner diameter decreases continuously, corresponding to the vials to be accommodated. The outer diameter in the region of the bottoms and cylindrical side-walls is larger than in the relatively short neck portion with the filling opening.

For stiffening the accommodation member 10, the side-walls 15 are connected to each other via stiffening ribs 18, which in turn are connected to the base plate 11 and which are particularly designed integrally with the base plate. For further reinforcement of the side-walls 15, these comprise several ribs extending in the longitudinal direction of the receptacles 14. The receptacles 14 are disposed in a two-dimensional regular arrangement, namely along rows extending in the y-direction, with adjacent rows being offset to each other by half a distance between the receptacles 14. Other arrangements of the receptacles 14 are also possible, for example in a two-dimensional matrix arrangement along rows and columns in the y-direction and x-direction, respectively, at even distances from each other.

The accommodation member 10 is formed in one piece by thermoforming a plastic material, in particular by deep-drawing a thin film or a thin film plate from a plastic material having a material thickness of up to 1.0 mm, preferably having a material thickness of up to 1.25 mm and even more preferably having a material thickness of up to 2.0 mm. PET, PS or PP is preferred as plastic material, wherein also multi-layer films may be used (e.g. PSEVOHPE/PPE-VOHPE . . . ). Conveniently, this plastic material is transparent to allow a visual inspection of the vials accommodated in the receptacles.

Figure 2A:
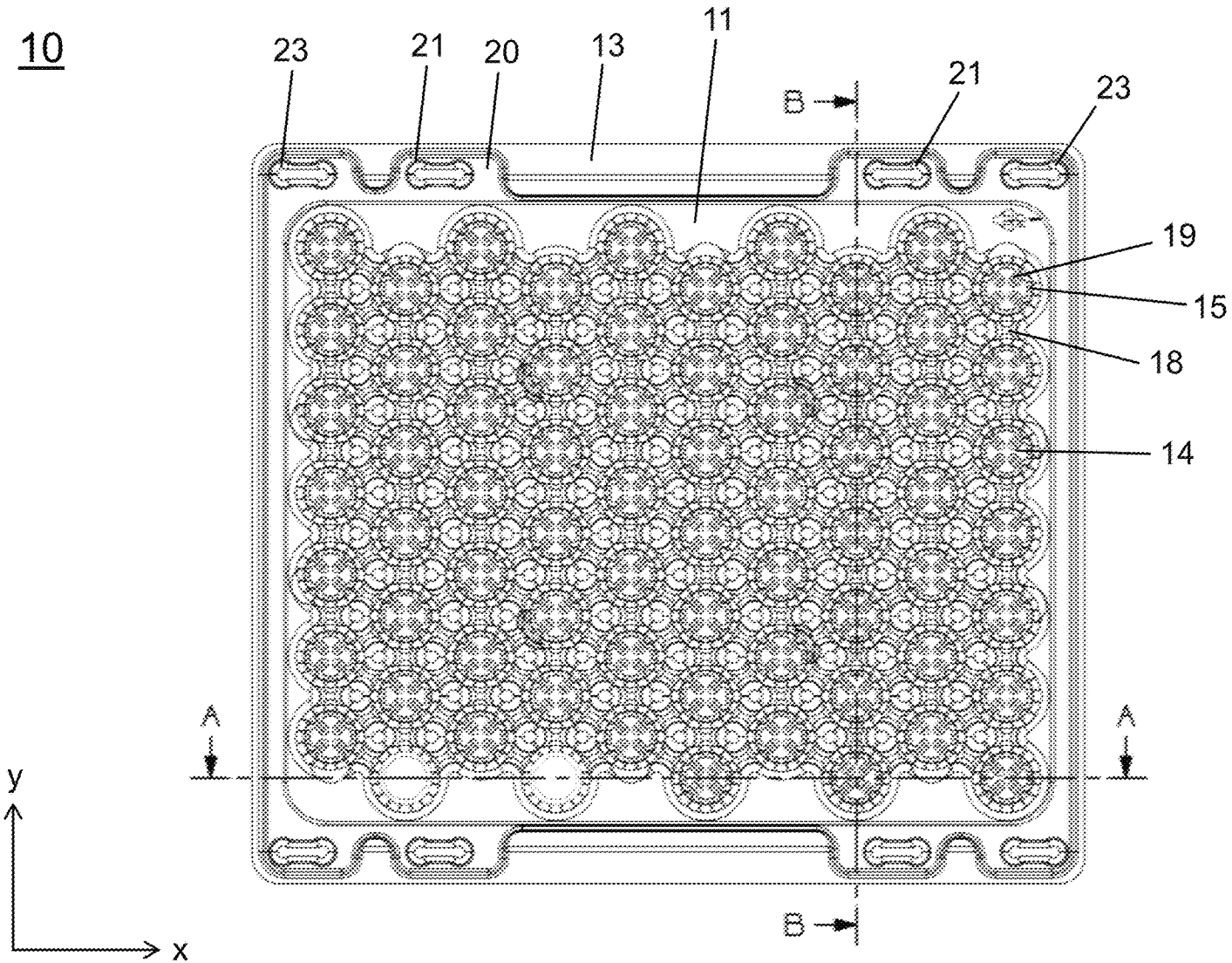
FIG. 2*a* shows the accommodation member of the transport structure according to FIG. 1*a* in a top view from below.
Figure 2B:
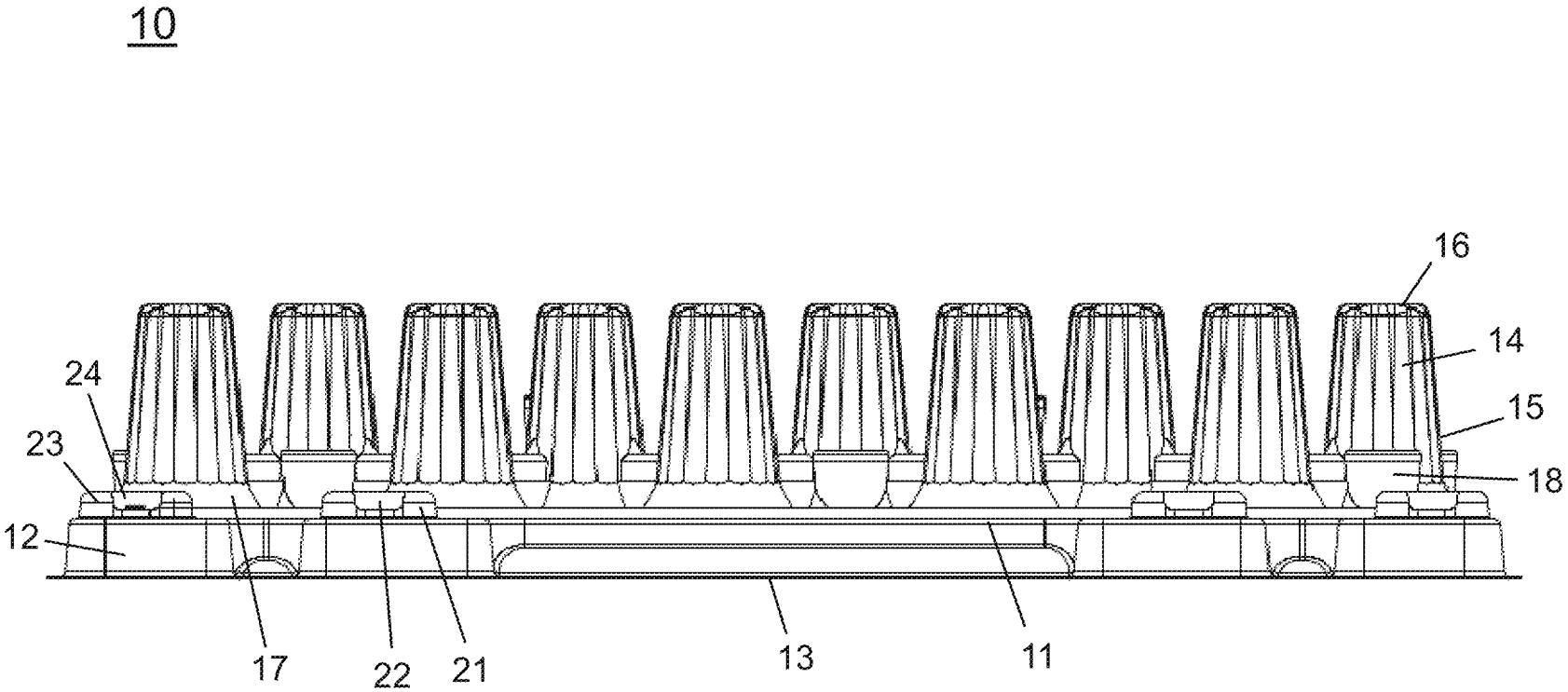
FIG. 2*b* shows the accommodation member according to FIG. 2*a* in a side view.
Figure 2C:
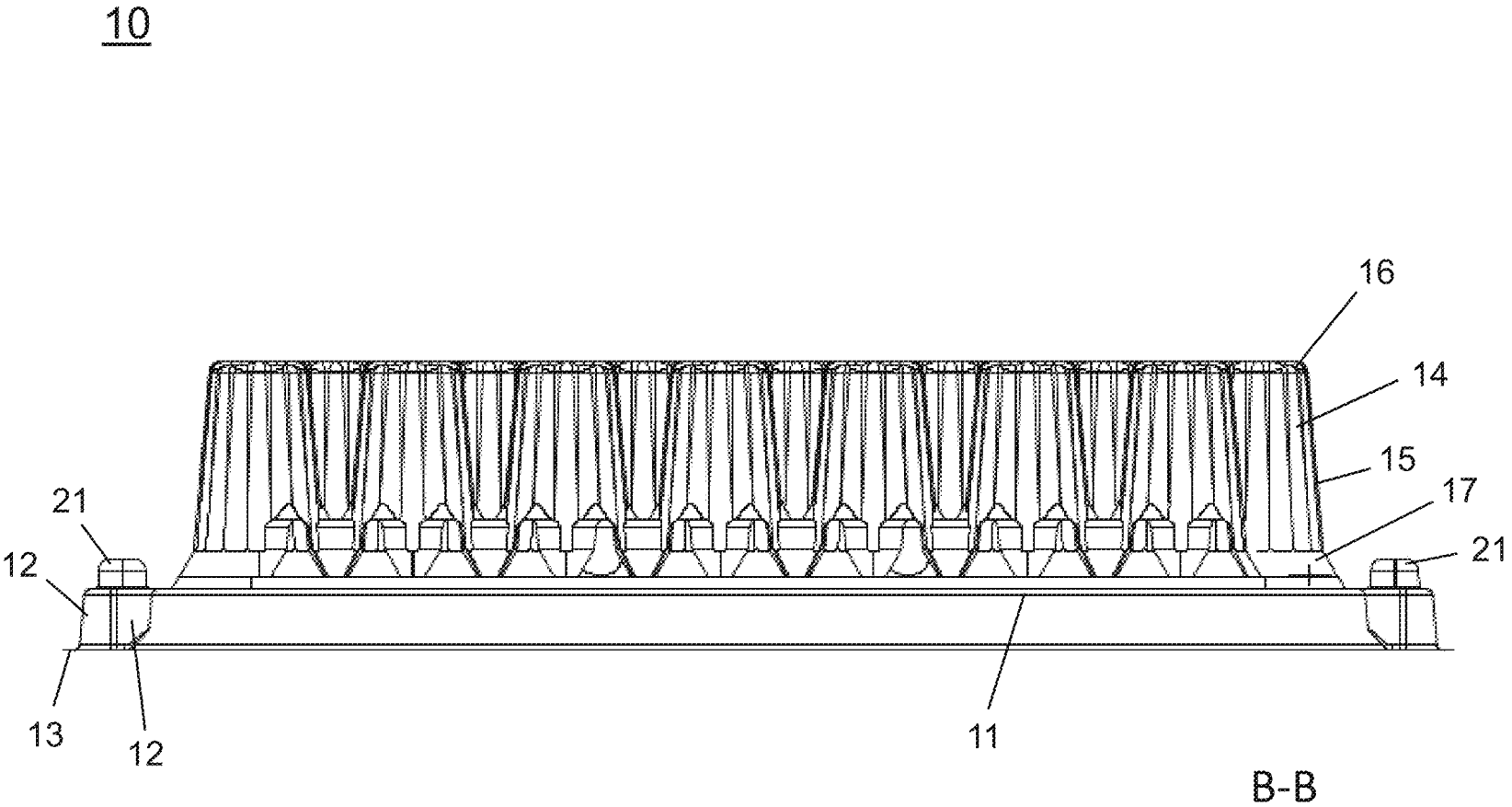
FIG. 2*c* shows the accommodation member according to FIG. 2*a* in a cross-sectional view along B-B of FIG. 2*a;*
Figure 4:
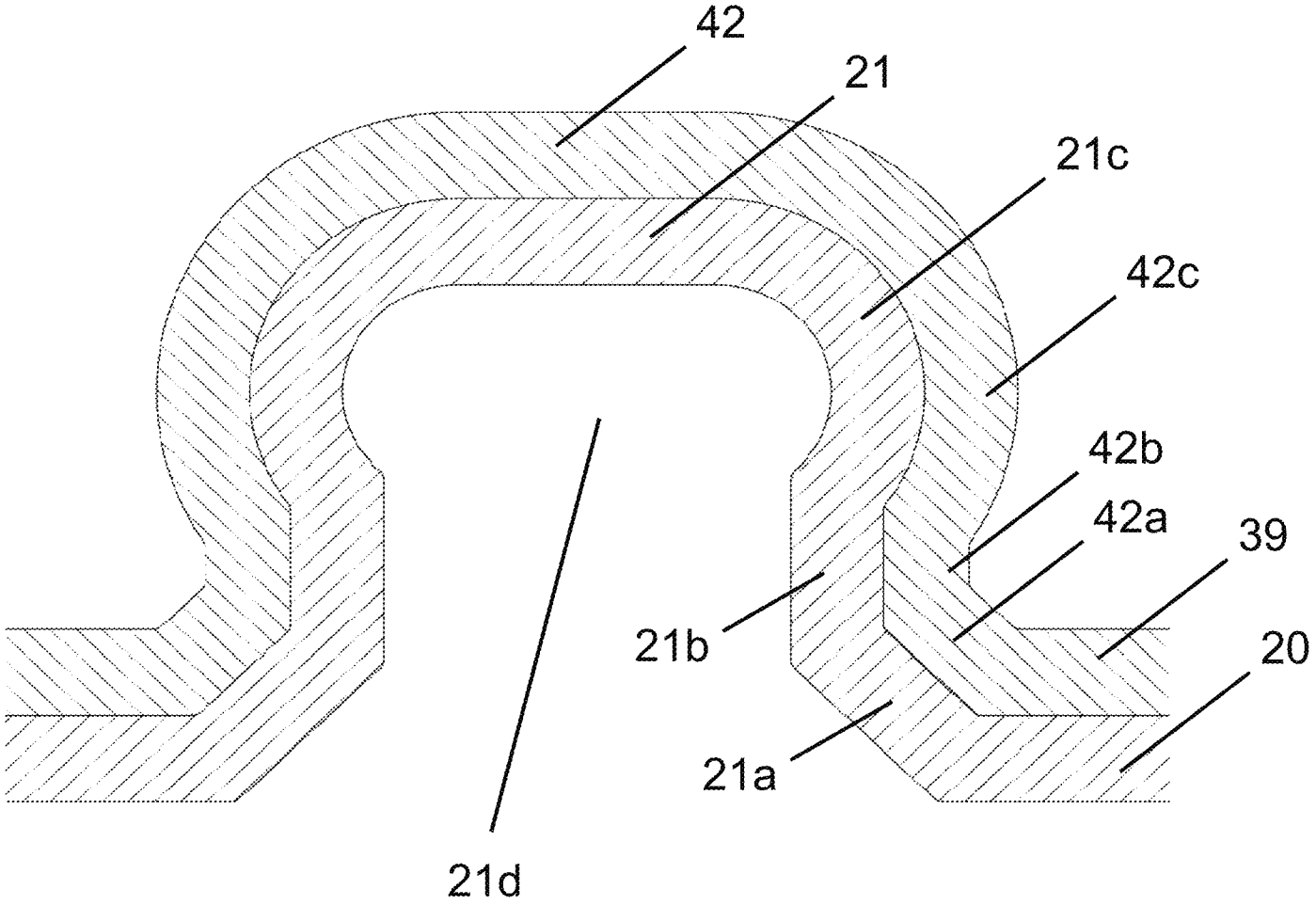
FIG. 4 shows an example of the positive engagement of latching structures of the bearing member with latching structures of the accommodation member in a schematic cross-sectional view.

As can be concluded from FIG. 2*b*, a raised edge 12 extends essentially perpendicularly from the base plate 11. The lower edge 13 of the accommodation member 10 spans a common plane extending in parallel with the plane of the base plate 11. In the plane of the base plate 11, several island-like protrusions 20 protrude laterally, on each of which latching structures 21, 23 are formed, namely outer latching structures 23 and inner latching structures 21, which are preferably identical. These latching structures 21, 23 are each formed by two laterally rounded portions, which are particularly mushroom-shaped in profile, as shown in FIG. 4, and which are connected to each other via a connecting web 22, 24 of a smaller diameter. As can be seen in FIG. 2*a*, the latching structures 21, 23 are hollow on their rear side due to the manufacturing of the accommodation member 10.

The side-walls 15 of the receptacles 14 are slightly inclined inwards (cf. FIG. 2*b*), which takes into account the fact that the vials to be accommodated have a larger outer diameter in the regions of their bottoms and cylindrical side-walls than in the relative short regions of their upper neck portions. The inner diameter of the receptacles 14 in the regions of the bottoms is preferably smaller than the outer diameter of the vials to be accommodated in the regions of their bottoms and cylindrical side-walls, so that the vials can only be accommodated in the receptacles 14 in an orientation specified by the geometry of the receptacles 14, i.e. in an upright orientation, i.e. with their upper neck portions being directed towards the bottoms of the receptacles 14. Due to the inclination of the side-walls of the receptacles 14, several accommodation members 10 can be stacked one on top of the other to save space, which helps to reduce disposal costs. When stacking the accommodation members 10 one on top of the other, the upper sides of the stiffening ribs 18 of a first accommodation member 10 rest on the back of the base plate 11 of a second accommodation member 10 stacked above, so that the inwardly inclined side edges 12 are also pushed into each other.

Figure 2D:
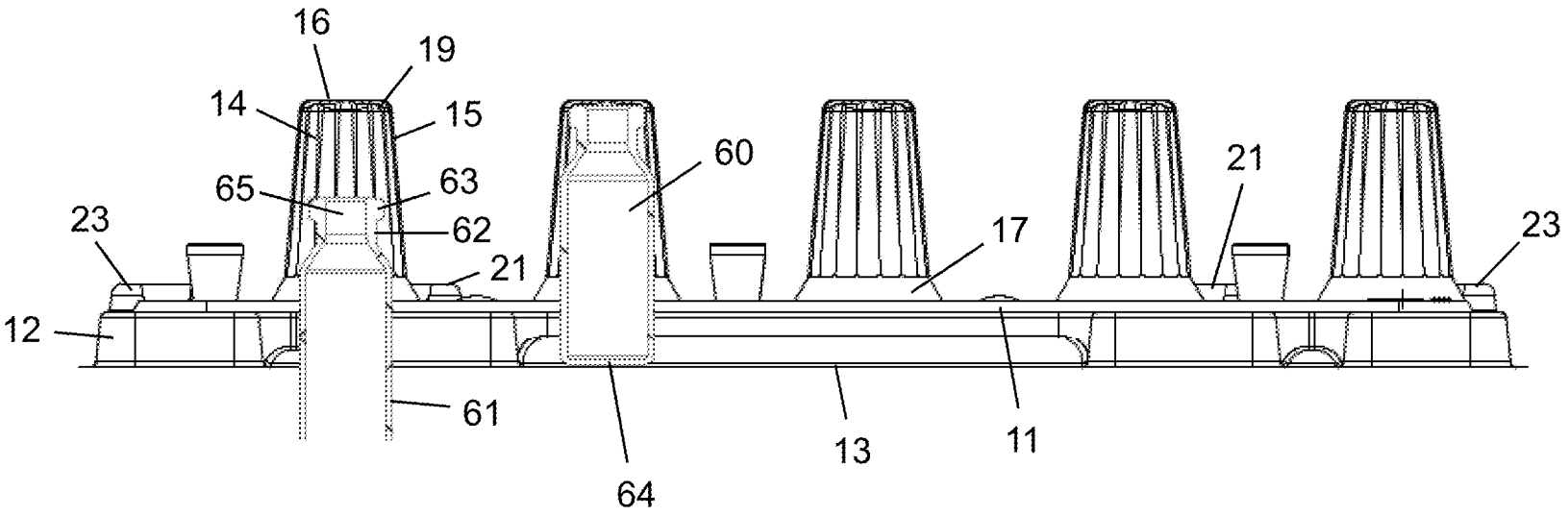
FIG. 2*d* shows the accommodation member according to FIG. 2*a* in a cross-sectional view along A-A of FIG. 2*a* with two vials in different positions.

FIG. 2*d* shows schematically how vials 60 are accommodated in the receptacles 14 of the accommodation member. The length of the receptacles 14 is larger than or equal to the axial length of the vials 60, so that these can be accommodated essentially completely within the receptacles 14 without protruding from the lower end of the receptacles 14. The ribs 19 on the inner sides of the bottoms 16 serve as spacers so that a small gap remains between the bottoms 16 of the receptacles 14 and the upper rims 63 of the vials 60, so that the inner volumes of the vials 60 can communicate with the inner volumes of the receptacle 14 via the filling openings 65 and this gap. Generally, this enables sterilizing the inner volumes of the vials 60 while these are accommodated in the transport structure, namely by a flow of a sterilizing gas flowing into the inner volumes of the vials 60 via the aforementioned gap.

FIG. 2*d* shows the intended orientation of the vials 60 during their storage in the transport structure according to the disclosure, namely upright within the receptacles 14, with the upper ends 63 of the vials facing the bottoms 16 of the receptacles. The bottoms 64 of the vials are essentially flush with the lower edge 13 of the accommodation member but may also be arranged completely within the volume formed by the lateral edge 12, which depends on the respective geometry of the associated bearing member, as described below.

Figure 3A:
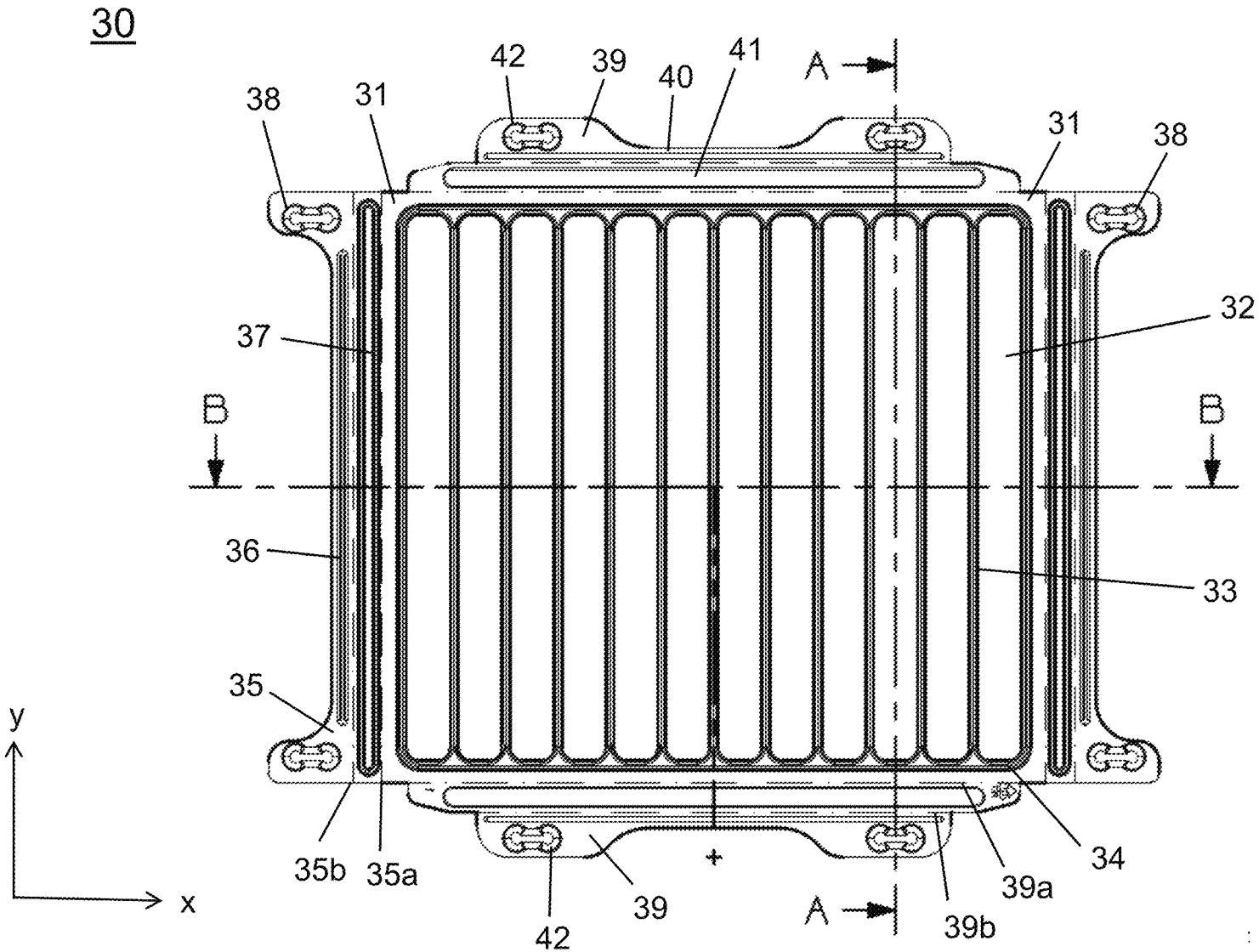
FIG. 3*a* shows the bearing member of the transport structure according to FIG. 1 a in a plan view.
Figure 3B:
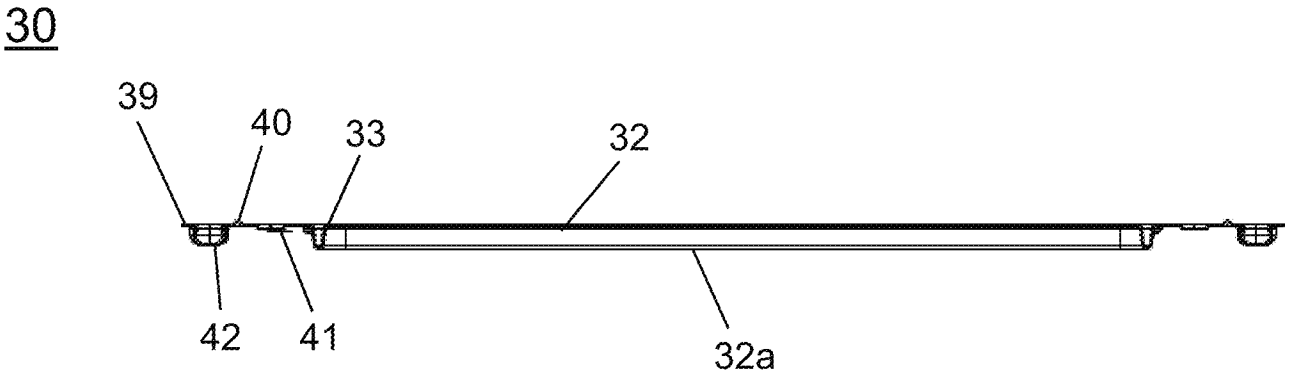
FIG. 3*b* shows the bearing member according to FIG. 3*a* in a cross-sectional view along A-A of FIG. 3*a;*
Figure 3C:
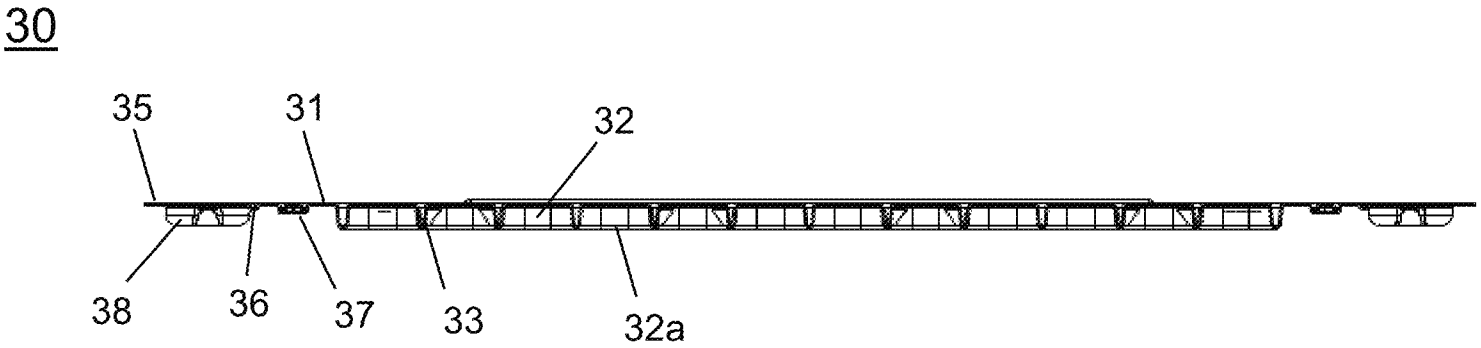
FIG. 3*c* shows the bearing member according to FIG. 3*a* in a cross-sectional view along B-B of FIG. 3*a;*
Figure 3D:
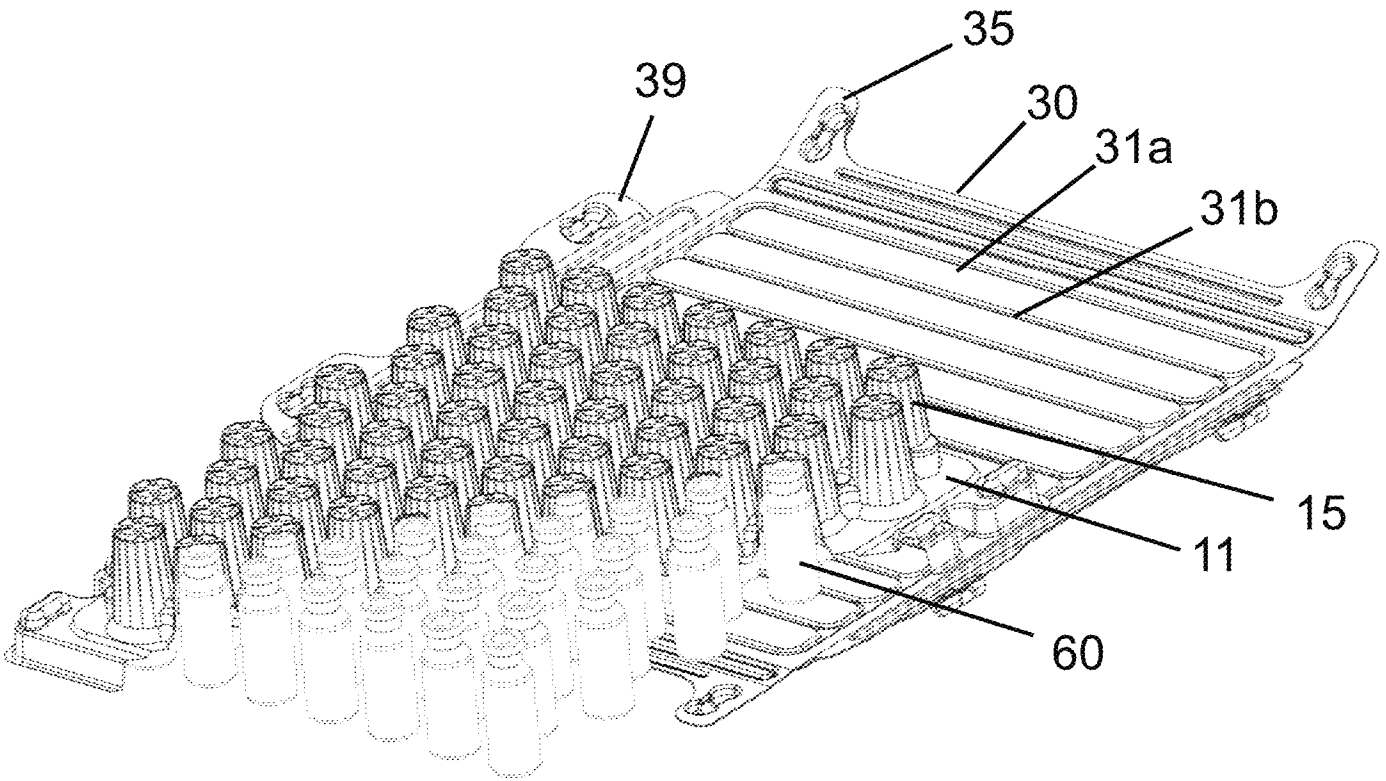
FIG. 3*d* shows, in a perspective view from above and in a partial cross-sectional view, a transport structure according to FIG. 1*a* in an open state while the vials are being pushed from the bearing member.
Figure 3E:
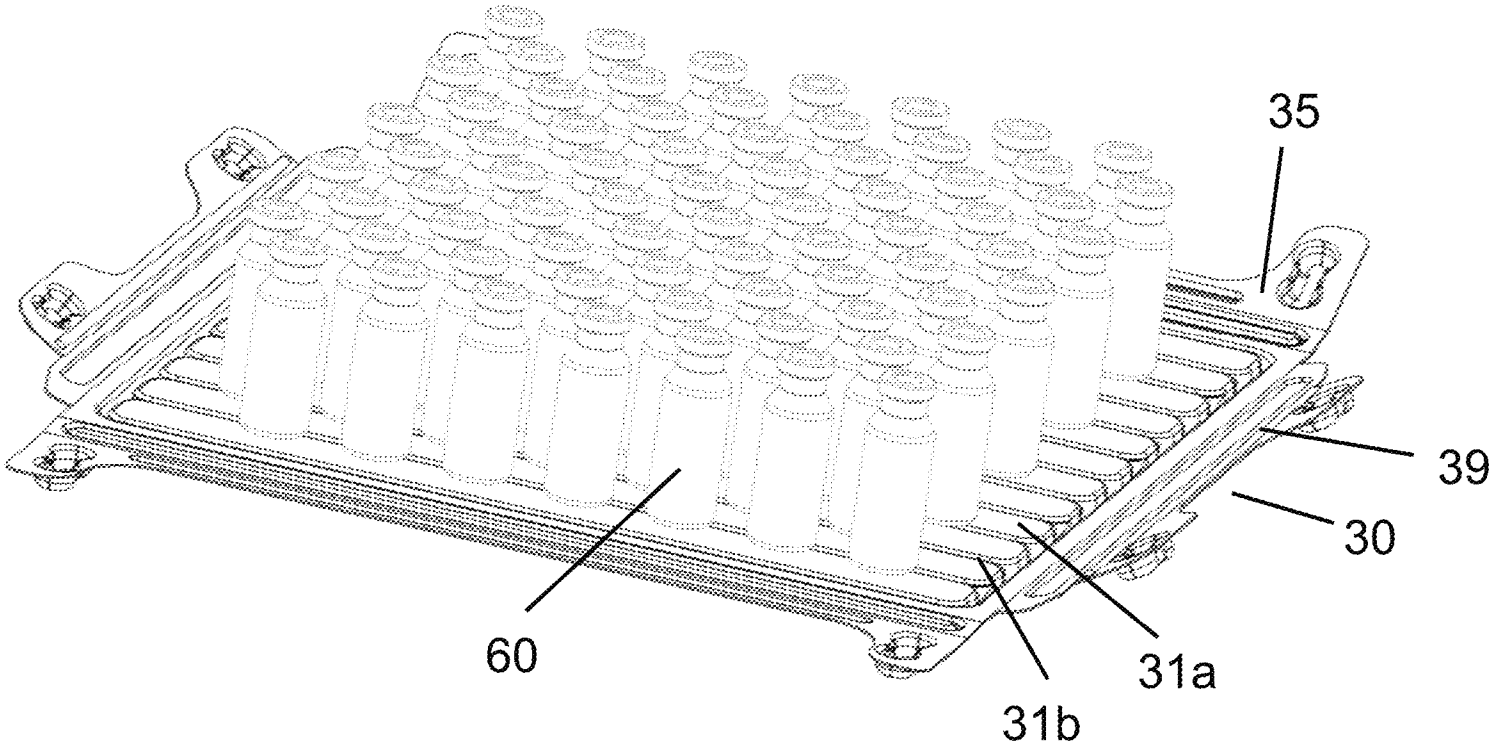
FIG. 3*e* shows the transport structure according to FIG. 1*a* with vials resting on the bearing member, the accommodation member not being shown.

According to the plan view of FIG. 3*a*, the bearing member 30 comprises a substantially flat, rectangular base plate 31 the outer dimensions of which correspond to those of the base plate 11 of the accommodation member 10. As can be seen in FIGS. 3*a* and 3*d*, the upper side of the base plate 31, i.e. the side of the bearing member 30 facing the accommodation member, is flat (planar). More specifically, a plurality of supporting surfaces 31*a* is formed on the upper side of the base plate 31 the widths of which essentially correspond to the widths of the vials and between which relatively narrow grooves 31*b* are formed. When the bearing member is detachably latched with the accommodation member, the supporting surfaces 31*a* are arranged relative to the receptacles in such a manner that the bottoms of the vials accommodated in rows in the accommodation member rest exactly in rows on these supporting surfaces 31*a*.

The supporting surfaces 31*a* jointly span a plane on which the bottoms of the vials rest when they are accommodated in the transport structure. In any case, the grooves 31*b* are so narrow that the vials can be pushed in any direction over the plane spanned by the supporting surfaces 31*a* without major 'jerking'. The grooves 31*b* serve to further stiffen the base plate 31, which is particularly advantageous if the bearing member 30 is formed from a thin film or a thin film plate of a plastic material by thermoforming, in particular by deep drawing. The vials are conveniently pushed from the base plate 31 in the longitudinal direction of the supporting surfaces 31*a* for further processing. In principle, however, they may also be pushed from the base plate 31 in any other direction, especially transversely to the grooves 31*b*, as shown in FIG. 3*d*.

Of course, according to other embodiments the upper side of the base plate 31 may also be completely flat, in particular without supporting surfaces 31*a* and grooves 31*b* described above.

FIG. 4 shows an example of the positive engagement of latching structures of the bearing member and of the accommodation member with each other in a schematic cross-sectional view. The latching structures 21, 42 are each formed in the form of a mushroom head, if viewed in profile, each having a transition portion 21*a* and 42*a*, respectively, which is formed slanted in FIG. 4, but which may also be curved or which may protrude substantially perpendicularly from the respective base plate 20 and 39, respectively, an adjoining narrowed portion 21*b* and 42*b*, respectively, and a latching head 21*c* and 42*c*, respectively, which has a larger width or is formed like a mushroom head. The latching structures 21, 42 are each formed hollow, the outer dimensions of the latching structure 21 on the protrusion 20 of the accommodation member corresponding to the inner dimensions of the latching structure 42 on one of the side wings of the bearing member, so that the latching structure 42 can be pressed onto the latching structure 21 to effect the positive engagement.

Figure 1B:
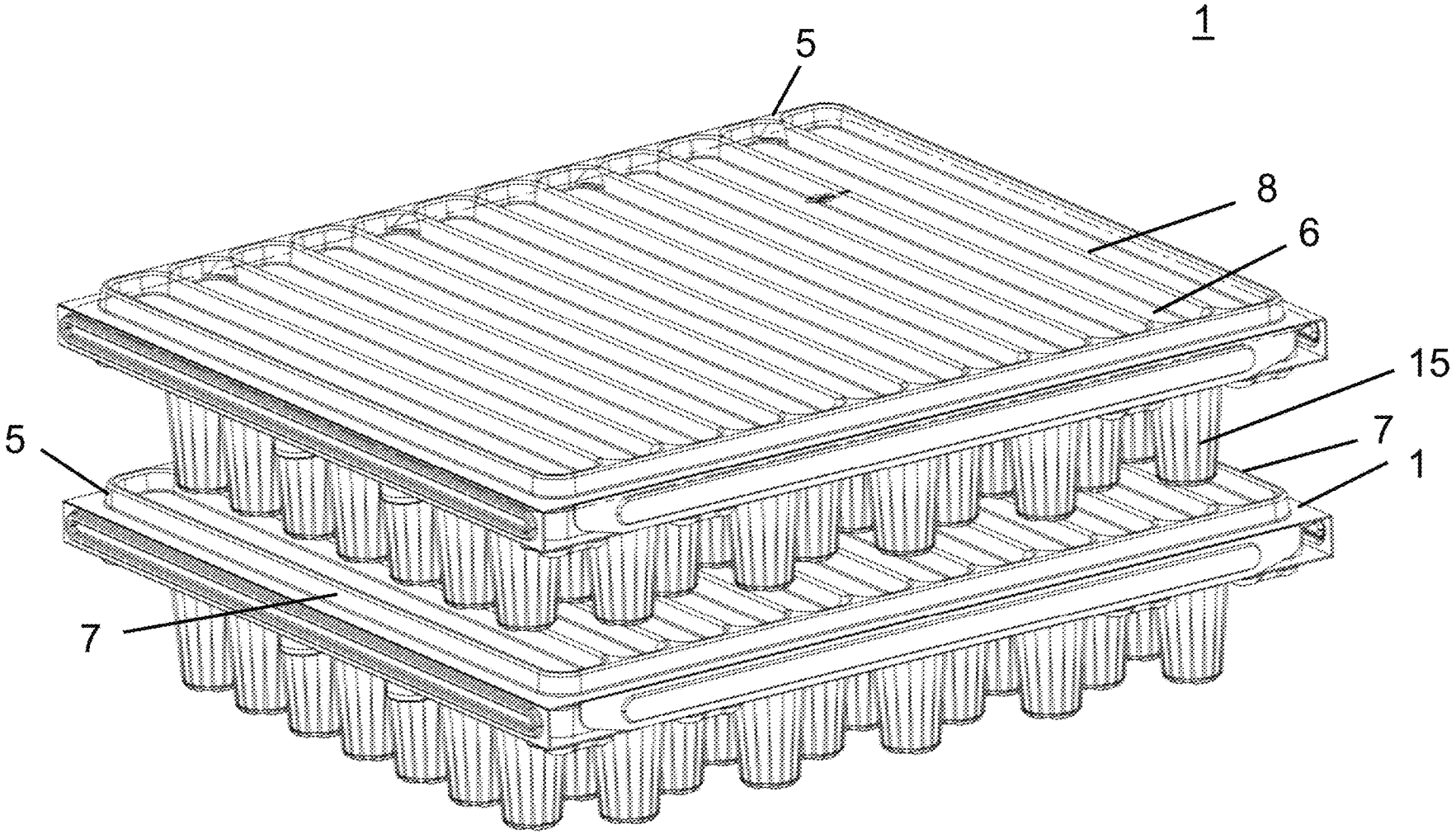
FIG. 1*b* shows two transport structures according to FIG. 1*a* in a closed state and stacked one above the other.

Several transport structures as shown in FIG. 1*a* can be arranged stacked one above the other, as shown in FIG. 1*b*. As shown in FIG. 1*b*, for this purpose a plurality of troughs 32 are formed on the underside of the base plate 31, i.e. on the side of the base plate 31 facing the accommodation member of a transport structure arranged above it, which extend in parallel with one another in the y-direction, each have the same width in the x-direction and the same length in the y-direction and are separated from one another by partitioning webs 33. The respective ends of the troughs 32 are rounded, but do not extend completely to the edges of the base plate 31, as shown in FIG. 3*a*. Thus, each of the troughs 32 is trough-shaped. The width of the troughs 32 corresponds to the outer diameter of the cylindrical side-walls 15 of the receptacles of the accommodation member, so that the closed upper ends of the receptacles are accommodated in the troughs 32 and guided laterally when two transport structures 1 are arranged stacked one above the other, as shown in FIG. 1*b*. The circumferential peripheral web and the rounded ends 34 of the troughs 32 on the underside of the base plate 31 prevent the upper transport structure 1 from slipping laterally relative to the lower transport structure 1. The troughs 32 and partitioning webs 33 also prevent the upper transport structure from slipping laterally in a direction perpendicular to the longitudinal direction of the troughs 32 and partitioning webs 33. Here, the troughs 32 and partitioning webs 33 serve to further stiffen the bearing member 30, so that it may also be made of relatively thin plastic plates, in particular by deep-drawing, as described below.

According to an alternative embodiment, an intermediate plate 5 is placed on the respective underside of the base plate of a bearing member, as shown in FIG. 1*b*, on the upper side of which a plurality of troughs 6 with partitioning webs 7 formed in between are formed like the troughs 32 and partitioning webs 33, respectively, as described above in conjunction with the design of the underside of the base plate 31 of a bearing member. According to this alternative embodiment, the intermediate plate 5 is matched to the underside of the base plate of a bearing member in such a manner that the intermediate plate 5 cannot be displaced relative to the bearing member when placed on the bearing member. Furthermore, the lengths of the rows of receptacles of the accommodation member are matched to the lengths of the troughs 6 on the upper side of an intermediate plate 5 in such a manner that the two transport structures 1*b* cannot be displaced both in the longitudinal direction of the troughs 6 and transversely to this longitudinal direction.

Thus, a plurality of transport structures 1 can be reliably stacked on top of each other to save space. In the stacked arrangement, for example as shown in FIG. 1*b*, the vials are arranged upside down in the receptacles of the respective accommodation member, i.e. with their upper ends or neck portions being directed downwards as shown in FIG. 1*b*. Of course, a plurality of transport structures may also be stacked one above the other in such a manner that the receptacles of the respective accommodation member are directed upwards and that hence the bottoms of the vials rest on the respective upper side of the base plate of a respective bearing member.

On the left-hand and right-hand side of the base plate 31 in FIG. 3*a* side wings 35 are formed which can be pivoted or folded downward along the folding lines 35*a*, 35*b*. More specifically, each of the side wings 35 is essentially C-shaped, wherein a recessed portion 36 is formed in a central portion. At the upper and lower end of the side wings 35, latching structures 38 are formed corresponding to the outer latching structures 23 of the accommodation member (cf. FIG. 2*a*). A rectangular portion having an additional recessed portion 37 is formed between the base plate 31 and the side wings 35, the width of this rectangular portion corresponding to the height of the lateral edge 12 of the accommodation member 10 (cf. FIG. 2*b*).

At the upper and lower edge of the base plate 31 in FIG. 3*a*, side wings 39 are formed which can be pivoted or folded along the folding lines 39*a*, 39*b*. More specifically, the side wings 39 are essentially C-shaped, wherein a recessed portion 40 is formed in the central portion. At the left and right end of the side wings 39, latching structures 42 are formed corresponding to the inner latching structures 21 of the accommodation member (cf. FIG. 2*a*). A rectangular portion having an additional recessed portion 41 is formed between the base plate 31 and the side wings 39, the width of this rectangular portion corresponding to the height of the lateral edge 12 of the accommodation member 10 (cf. FIG. 2*b*).

According to another preferred embodiment (not shown), the upper side wing 39 shown in FIG. 3*a* is completely missing, so that the vials can then be pushed from the base plate 31 even more freely, as outlined below.

The bearing member 30 is formed in one piece by thermoforming a plastic material, in particular by deep-drawing a thin film or a thin film plate from a plastic material having a material thickness of up to 1.0 mm, preferably having a material thickness of up to 1.25 mm and even more preferably having a material thickness of up to 2.0 mm. Preferably, PET, PS or PP is used as the plastic material, wherein also multi-layer films may be used (e.g. PSEVOHPE/PPEVOHPE . . . ). Conveniently, this plastic material is transparent to allow a visual inspection of the vials accommodated in the receptacles.

Referring to FIGS. 2*a* to 3*e*, for forming the transport structure 1 shown in FIG. 1*a*, first an accommodation member 10 is arranged with the receptacles 14 facing downwards and the vials 60 are then inserted upside-down into the receptacles 14 until the upper rims 63 of the vials 60 rest on the protrusions 19 on the closed ends 16 of the receptacles 14. Then a bearing member 30 is placed on the accommodation member 10 with the upper side of the base plate 11 facing upwards, so that the bottoms 64 of the vials 60 abut against the supporting surfaces 31*a* of the base plate 11 of the bearing member 30 or are arranged at a short distance from them. Then the side wings 35, 39 of bearing member 30 are folded twice along the folding lines 35*a*, 35*b* and 39*a*, 39*b*, respectively, towards the upper side of the base plate 11 of the accommodation member 10 so that the latching structures 42 on the side wings 39 are then pressed onto the inner latching structures 21 of the accommodation member 10, so that the latching structures 38 on the side wings 35 of the bearing member 10 are pressed onto the outer latching structures 23 of the accommodation member 10 and so that the latching structures 21/42 and 23/38, respectively, are latched with each other, whereby bearing member 30 and accommodation member 10 are detachably connected to each other.

As an alternative to the forming of the transport structure 1 shown in FIG. 1*a*, first a bearing member 30 may be arranged with the upper side of the base plate 11 directed upwards. Then, the vials 60 are placed upright on the supporting surfaces 31*a* corresponding to the arrangement of the receptacles 14 of the accommodation member 10. Then, the accommodation member 10 with the receptacles facing upwards is lowered onto the bearing member 10 so that the vials 60 are inserted into the receptacles 14 of the accommodation member 10. Then, the side wings 35, 39 of the bearing member are folded twice and the bearing member 30 is latched to the accommodation member 10, as described above.

Or the vials 60 are arranged upright on a work surface (not shown) corresponding to the arrangement of the receptacles 14 of the accommodation member 10. Then the accommodation member 10 with the receptacles facing upwards is lowered onto the bearing member 10 so that the vials 60 are inserted into the receptacles 14 of the accommodation member 10. Then the accommodation member 10 with the vials 60 accommodated therein is pushed onto the upper side of the base plate 11 of the bearing member 10. Then the side wings 35, 39 of the bearing member are folded over and the accommodation member 30 is latched to the bearing member 10, as described above.

Or the vials 60 are inserted upside down into the receptacles 14 of the accommodation member 10 oriented vertically downwards. Then the bearing member 30 with the upper side of the base plate 11 facing downwards is pushed onto the accommodation member 10 with the vials 60 accommodated therein. Then the side wings 35, 39 of the bearing member are folded over and the bearing member 30 is latched to the accommodation member 10, as described above.

FIG. 1*a* shows the transport structure 1 formed in this manner. Because the vials are accommodated in the receptacles of the accommodation member and the upper rims of the vials are covered by the closed ends of the receptacles, penetration of impurities, in particular resulting from material abrasion, into the vials is reliably prevented. The sidewalls of the receptacles also prevent a contact of directly adjacent vials in the transport structure and during handling, so that mechanical damage to the vials, particularly scratches, is reliably prevented.

The accommodation member and bearing member are detachably connected to each other via the latching structures. Even though the side wings of the bearing member are folded down twice for latching and the latching structures are latched together, the side wings preferably do not exert any additional frictional coupling. Rather, the position of the accommodation member relative to the bearing member is preferably solely the result of the positive-fit formed by the latching structures.

A plurality of such transport structures can be stacked on top of each other. Here, intermediate plates are preferably arranged between the transport structures, as shown in FIG. 1*b*.

In the configuration of FIG. 1*a*, the transport structure with the vials accommodated therein under non-sterile conditions can be transported. Or, in the configuration of FIG. 1*b*, a plurality of transport structures with the vials accommodated therein under non-sterile conditions can be transported stacked on top of each other. The transport structure according to the present disclosure preferably is to serve for the transport of vials not yet sterile packaged, for example to a pharmaceutical filling company, where the vials are filled after cleaning and sterilization.

If a transport in the transport structure according to the present disclosure is nevertheless desired under sterile conditions, for example the transport of cleaned and sterilized vials to a pharmaceutical filling company in a 'ready to use' (RTU) state, the transport structure with the vials accommodated therein is cleaned and sterilized and placed in at least one sterile outer packaging bag, for example in a plastic tube, which is then sterile sealed. This sterile outer packaging bag(s) is then opened again under suitable sterile processing conditions for further processing, for example at a pharmaceutical filling company.

The procedure for opening the transport structure of FIG. 1*a* and transferring the vials accommodated therein to a processing station, for example a filling station at a pharmaceutical filling company, is as follows:

First, the transport structure together with the bearing member facing downwards is placed on a work surface. Then the latching of the latching structures 38, 42 of the bearing member 30 with the latching structures 21, 23 of the accommodation member 10 is released from above the transport structure 1, i.e. from the side of the accommodation member, without lifting the accommodation member 10. For a manual handling, the gaps between the side wings 39 and the latching structures 38 or laterally of the side wings 35 are available, as shown in FIG. 1*a*. In the case of an automatic or semi-automatic handling, grippers or the like engage with these interspaces. Then the side wings 35, 39 are folded back. While the side wings 35 do not need to be folded down completely, at least the side wing 39 must be completely folded down at one of the ends of the supporting surfaces 31*a* on the upper side of the base plate 31 so that the vials can be pushed from the supporting surfaces 31*a* and from the base plate 31.

The vials are then pushed from the supporting surfaces 31*a* and from the base plate 31 by a relative displacement of the accommodation member 10 and the bearing member 30. The relative displacement between accommodation member 10 and bearing member 30 may be guided laterally and may only be possible in one direction, namely in the y-direction, for which purpose, for example, the two side wings 35 may be used in a position folded halfway upwards. For the relative displacement, preferably the bearing member 30 is temporarily fixed, for example on the supporting surface, and only the bearing member 10 is displaced in the y-direction.

In this way, the vials 60 are pushed from the base plate 31 of the bearing member 30 and thus fed to the downstream processing station. According to the present disclosure, no turning of the transport structure 1 is required for feeding.

According to a preferred embodiment, the bearing member comprises only two folding side wings disposed along two opposite sides. This offers additional advantages, especially for processing stations to be loaded manually or semi-automatically with prior separation of the vials, for example by means of an insulator with a rotary carousel. For this purpose, the accommodation member and the bearing member are rectangular if viewed in a plan view, with longer sides, on which, for example, the two side wings may be provided on the bearing member, and with two shorter sides. First, the transport structure is placed on a supporting surface which merges into a conveyor path to the processing station, wherein the width of the conveyor path corresponds to the length of the shorter sides. When being placed on the supporting surface, the longer sides are aligned transversely to the conveyor path. First, the latching structures are released. The transport structure is then rotated by 90 degrees so that the longer sides extend in parallel with the conveyor path. Then the two side wings are folded down. The accommodation member is then moved in the direction of the conveyor path. In this process, the vials accommodated in the accommodation member are pushed from the bearing member onto the conveyor belt via one of the two shorter sides, from where they are then conveyed to the processing station, for example via a conveyor belt or via a rotary carousel of an insulator for separating the vials.

LIST OF REFERENCE NUMERALS

1 transport structure
5 intermediate plate
6 trough on intermediate plate 5
7 circumferential peripheral web on intermediate plate 5
8 partitioning web
10 accommodation member
11 base plate
12 lateral edge
13 lower edge
14 receptacle
15 cylindrical side-wall of receptacle 14
16 closed upper end of receptacle 14
17 base of cylindrical side-wall 15 of receptacle 14
18 connecting rib
19 protrusion at closed upper end 16 of receptacle 14
20 protrusion
21 inner latching structure
21*a* transition portion
21*b* constricted portion
21*c* latching head
21*d* cavity
22 connecting web
23 outer latching structure
24 connecting web
30 bearing member
31 base plate
31*a* supporting surfaces
31*b* groove
32 trough
32*a* bottom of trough 32
33 partitioning web
34 rounded end of trough 32
35 first side wing
35*a* inner folding line
35*b* outer folding line
36 recessed portion
37 recessed portion
38 first latching structure
39 second side wing
39*a* inner folding line
39*b* outer folding line
40 recessed portion
41 recessed portion
42 second latching structure
42*a* transition portion
42*b* constricted portion
42*c* latching head
60 vial
61 cylindrical side-wall of vial 60
62 constricted neck portion of vial 60
63 expanded upper rim of vial 60
64 bottom of vial 60
65 filling opening of vial 60

What is claimed is:

1. A transport structure, comprising:

an accommodation member, wherein the accommodation member comprises a plurality of receptacles in a regularly spaced arrangement, wherein each of the plurality of receptacles has a top and a bottom;

a bearing member releasably connected to the accommodation member, wherein the bearing member comprises a base plate, and the base plate has a flat supporting surface;

a plurality of vials, wherein each of the plurality of vials has an upper end and a bottom end, and a filling opening at the upper end;

latching structures for releasably latching the accommodation member with the bearing member;

wherein each of the plurality of vials is in a different one of the plurality of receptacles, so that the upper ends of the vials are at the bottoms of the receptacles and adjacent vials do not contact one another, wherein the bearing member covers the bottom ends of the vials, wherein the bearing member has a side wing, wherein the latching structures are on the side wing, so that the latching structures are accessible from a side of the accommodation member for releasing the latching members, and wherein the flat supporting surface faces the receptacles, and wherein the base plate is capable of being pulled in a direction parallel to the flat supporting surface, and wherein the plurality of vials are separated from the bearing member without any movement of the accommodation member relative to the bearing member in a direction perpendicular to the flat supporting surface.

2. The transport structure as claimed in claim 1, wherein the bottoms of each of the plurality of vials are in direct contact with the supporting surface of the bearing member when the plurality of vials are in the associated receptacles.

3. The transport structure as claimed in claim 1, wherein the accommodation member is releasably connected to the bearing member without additional coupling mechanisms.

4. The transport structure as claimed claim 1, wherein the accommodation member is releasably connected to the bearing member without additional clamping on the bearing member or without additional clamping by the bearing member.

5. The transport structure as claimed in claim 1, wherein the latching of the latching structures can be formed and released by adjusting movable members on the bearing member or on the accommodation member without height offset of the accommodation member relative to the bearing member.

6. The transport structure as claimed in claim 5, wherein the latching structures comprise latching structures on the side wing of the base plate of the bearing member and latching structures provided at the edge of the accommodation member, wherein the side wing can be folded from a latching position, in which the side wing embraces an edge of the accommodation member, into a release position, in which the side wing extends in extension of the base plate of the bearing member, and wherein the latching structures of the bearing member are latched with the latching structures of the accommodation member in the latching position.

7. The transport structure as claimed in claim 6, wherein the latching structures of the bearing member can be pressed onto the latching structures of the accommodation member to form the latching.

8. The transport structure as claimed in claim 6, wherein the latching structures corresponding to one another and are in the shape of a mushroom head, in a side view.

9. The transport structure as claimed in claim 6, wherein the accommodation member comprises a base plate on which the receptacles are formed, the base plate having a raised edge, wherein the side wing of the bearing member is foldable along two folding lines spaced apart to each other and extending in parallel with each other, comprising a foldable central portion formed between the two folding lines, the width of which corresponds to the height of the raised edge, and wherein at least one foldable latching portion on which the latching structures of the bearing member are formed.

10. The transport structure as claimed in claim 9, wherein compensating or stiffening portions extending along the edge of the bearing member are formed on the bearing member between the side wing and the base plate, and wherein additional compensating or stiffening portions are formed on the side wing, to temporarily compensate for an expansion of the material of the side wing when the latching structures are latched.

11. The transport structure as claimed in claim 10, wherein the compensating or stiffening portions are formed as recessed portions by thermoforming or by deep-drawing the material of the bearing member.

12. The transport structure as claimed in claim 6, wherein the bearing member comprises only two foldable side wings on two opposite sides of the bearing member.

13. The transport structure as claimed in claim 1, wherein the supporting surface of the base plate facing the receptacles is a plurality of supporting surfaces which together span a plane and are arranged relative to the receptacles such that the bottoms of the plurality of vials each rest directly on the supporting surfaces, wherein the plurality of supporting surfaces have grooves therebetween, and wherein the width of the grooves is less than the diameter of the vials.

14. The transport structure as claimed in claim 1, further comprising a plurality of troughs on an underside of the base plate facing away from the accommodation member, wherein the plurality of troughs are separated from one another by partitioning webs, wherein the width of the troughs corresponds to an outer diameter of the receptacles at the bottoms of the receptacles of the accommodation member, so that a plurality of transport structures can be stacked one above the other in a stacked arrangement, in which the front ends of the receptacles of the accommodation member of a first transport structure are accommodated directly in the troughs of the bearing member of a second transport structure and secured against lateral slipping.

15. The transport structure as claimed in claim 1, wherein the receptacles have side-walls, and the side-walls are connected to one another with stiffening ribs which are connected to a base plate of the accommodation member and which are formed integrally therewith.

16. The transport structure as claimed in claim 1, wherein there is no sterility cover that covers the accommodation member, the bearing member, and the plurality of vials.

17. The transport structure as claimed in claim 1, wherein the accommodation member and the bearing member are designed such that the accommodation member can be stacked with additional accommodation members of identical configuration and that the bearing member can be stacked with additional bearing members of identical configuration.

18. The transport structure as claimed in claim 1, wherein at least one of the accommodation member and the bearing member is integrally formed by thermoforming a plastic.

19. The transport structure as claimed in claim 18, wherein the thermoforming a plastic comprises deep-drawing from a plate-like plastic material.

20. The transport structure as claimed in claim 19, wherein the at least one of the accommodation member and the bearing member is formed by deep-drawing a thin film or a thin film plate having a material thickness of up to 2.0 mm.

21. The transport structure as claims in claim 1, wherein each of the plurality of receptacles has a frustro-conical shape, wherein each of the plurality of frustro-conical receptacles has a top and a bottom, and wherein each of the plurality of frustro-conical receptacles has a diameter at the bottom that is smaller than a diameter at the top.

22. The transport structure as claimed in claim 1, wherein each of the plurality of vials is completely in the associated receptacle.

* * * * *